US010065299B2

(12) United States Patent
Shields

(10) Patent No.: US 10,065,299 B2
(45) Date of Patent: Sep. 4, 2018

(54) DEVICE FOR AIDING IN DISPOSAL INSTALLATION

(71) Applicant: Donald E. Shields, Yorktown, VA (US)

(72) Inventor: Donald E. Shields, Yorktown, VA (US)

( * ) Notice: Subject to any disclaimer, the term of this patent is extended or adjusted under 35 U.S.C. 154(b) by 0 days.

(21) Appl. No.: 15/390,046

(22) Filed: Dec. 23, 2016

(65) Prior Publication Data

US 2018/0178360 A1 Jun. 28, 2018

(51) Int. Cl.

| | |
|---|---|
| ***B21D 39/03*** | (2006.01) |
| ***B25B 27/14*** | (2006.01) |
| ***E03C 1/22*** | (2006.01) |

(52) U.S. Cl.
CPC ..... *B25B 27/14* (2013.01); *E03C 1/22* (2013.01)

(58) Field of Classification Search
CPC ..... B25B 27/14; E03C 1/22
See application file for complete search history.

(56) References Cited

U.S. PATENT DOCUMENTS

| | | | |
|---|---|---|---|
| 5,177,853 | A | 1/1993 | Herook |
| 6,557,229 | B1 | 5/2003 | Ricci |
| 6,993,816 | B2 | 2/2006 | Greenhill |
| 7,140,086 | B2 | 11/2006 | Heaton |
| 7,185,408 | B1 | 3/2007 | Keith |
| 7,921,532 | B2 | 4/2011 | Heaton |
| 8,826,505 | B2 | 9/2014 | Dines et al. |
| 8,931,153 | B1 | 1/2015 | Kimminau |
| 2003/0192162 | A1 | 10/2003 | Ramirez |
| 2007/0000116 | A1 | 9/2007 | Goldburt et al. |
| 2009/0199382 | A1 | 8/2009 | Heaton |
| 2011/0154634 | A1 | 6/2011 | Heaton |

OTHER PUBLICATIONS

"It is time to change the strainer" Our Wolf Den [online] Retreived from the internet: <URL: https://ourwolfden.wordpress.com/2013/08/01/it-is-time-to-change-the-strainer/>.

*Primary Examiner* — Ryan J Walters
(74) *Attorney, Agent, or Firm* — Richard L Miller

(57) ABSTRACT

A plumbing tool that mounts an adapter of a garbage disposal to a sink, wherein the adapter of the garbage disposal includes an upper mounting ring with a trio of screws, a backup flange, a fiber gasket, a sink flange, and a snap ring. The plumbing tool includes a lower portion, an upper portion, and an apparatus. The apparatus selectively draws the lower portion to the upper portion to capture the adapter of the garbage disposal therebetween and thereby mount the adapter of the garbage disposal to the sink.

28 Claims, 14 Drawing Sheets

METHOD FOR UTILIZING THE PLUMBING TOOL (10) TO INSTALL THE ADAPTER (12) THAT MOUNTS THE GARBAGE DISPOSAL (66) TO THE SINK (28)
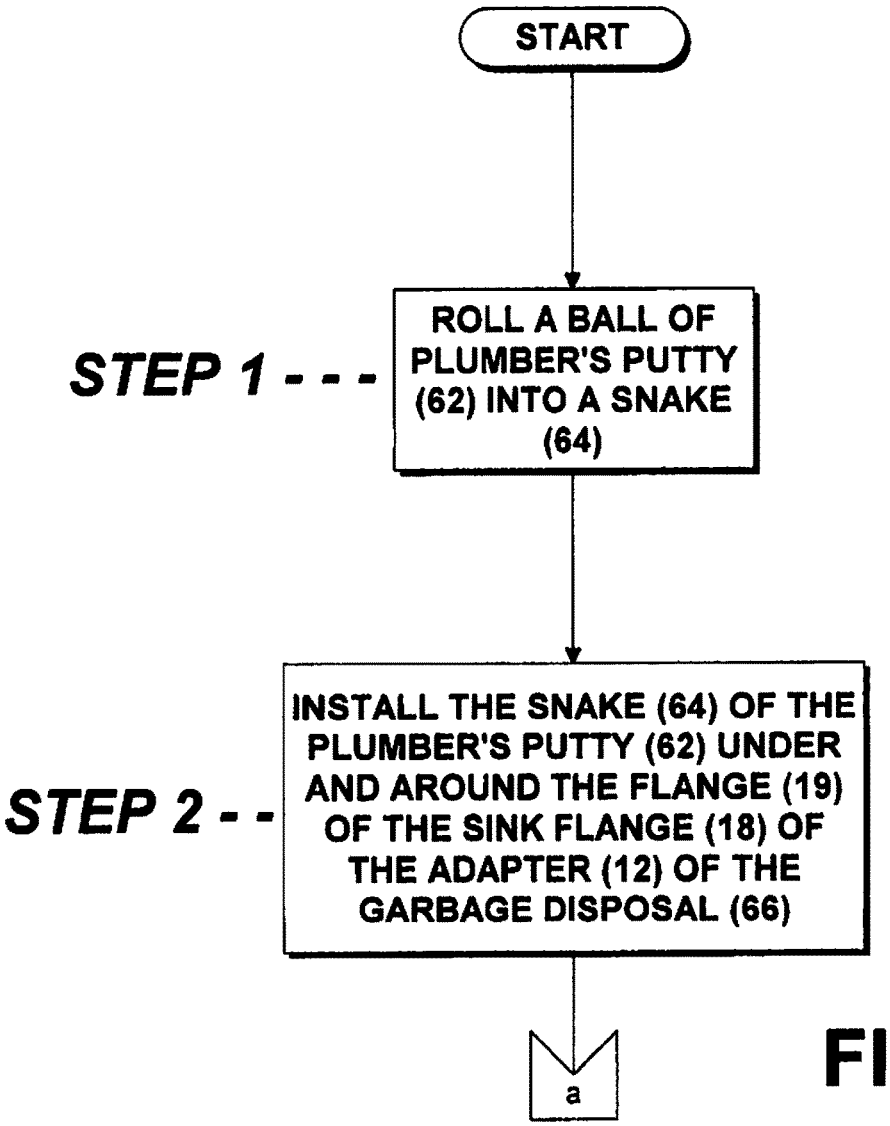
FIG. 7-A

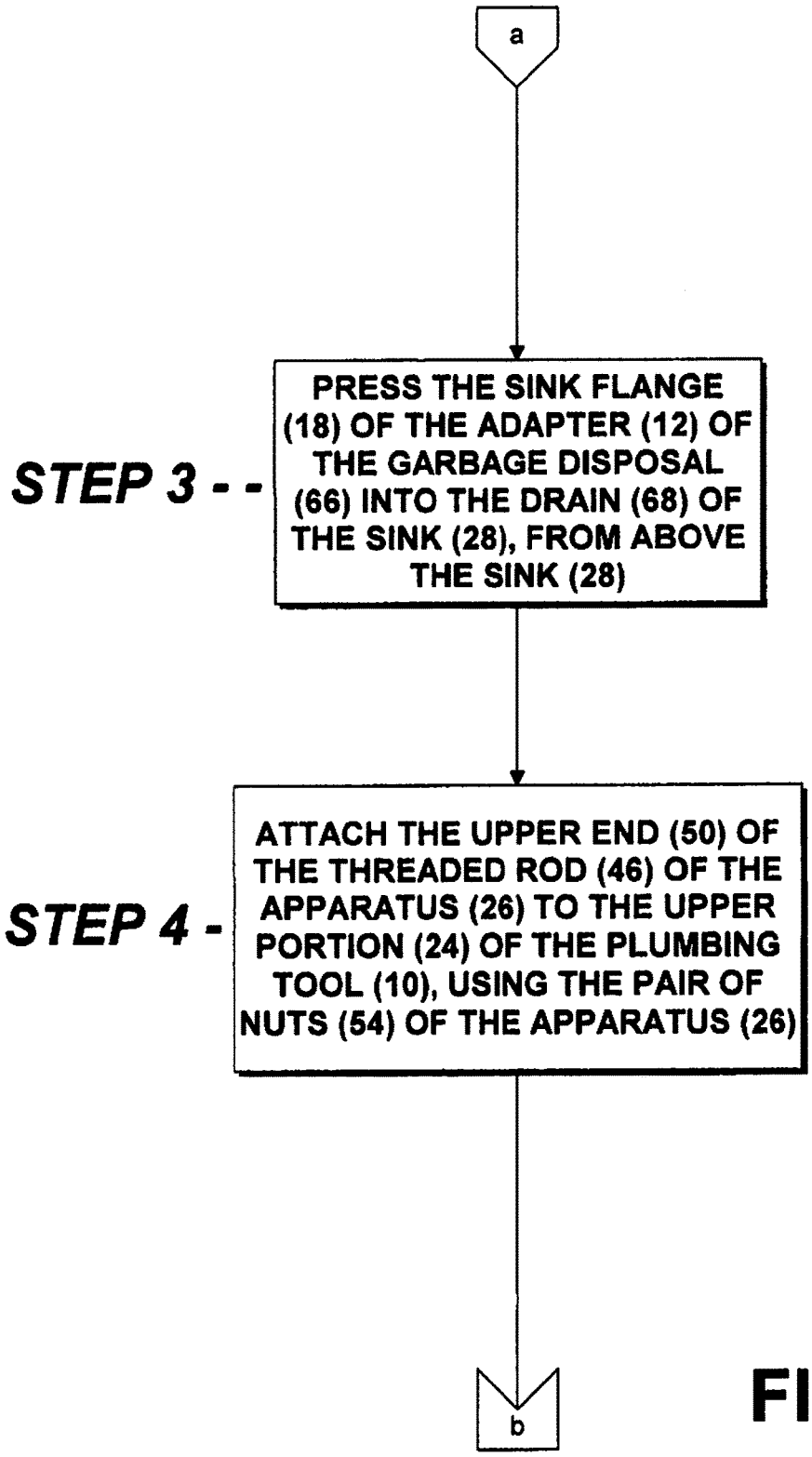
FIG. 7-B

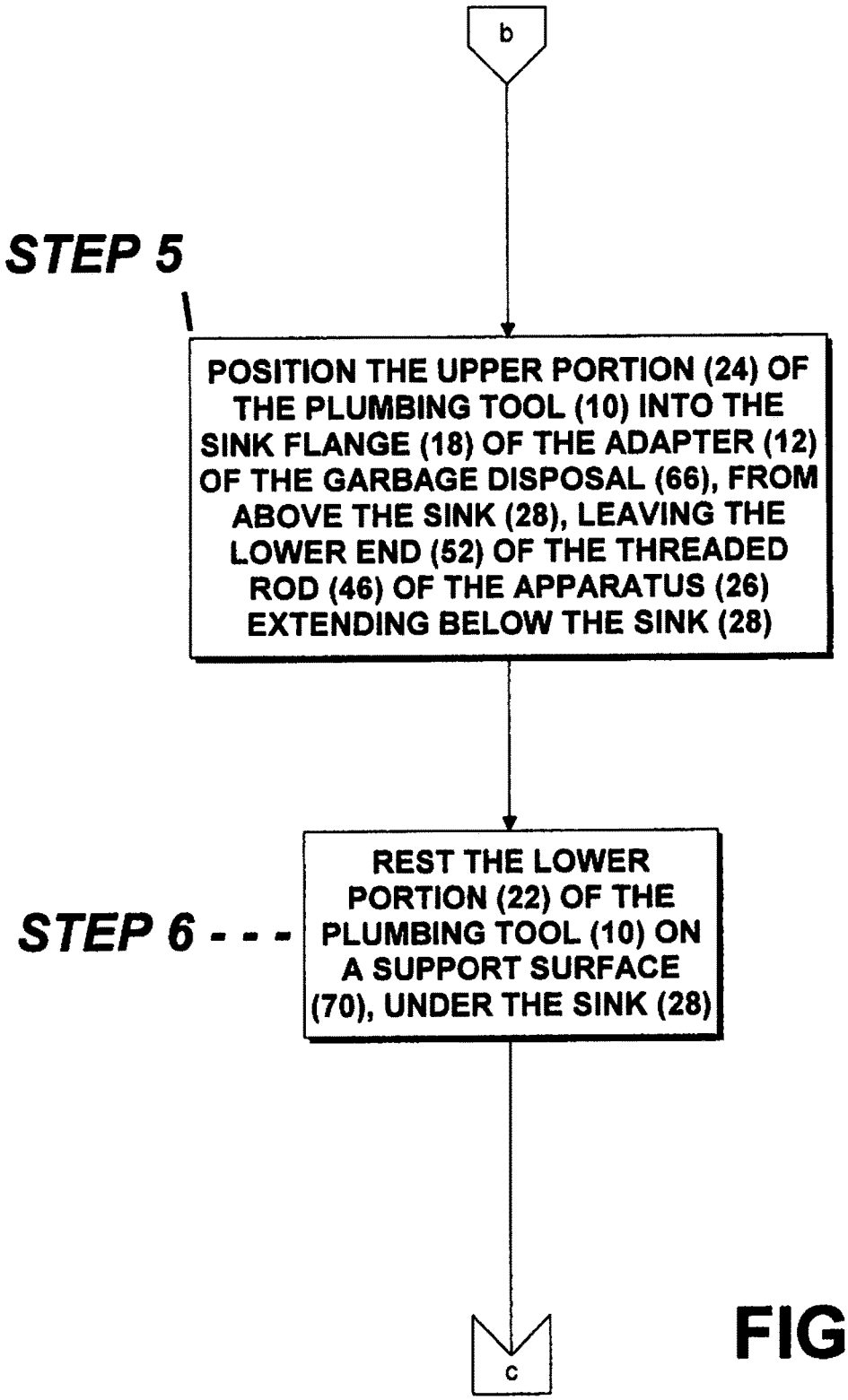
FIG. 7-C

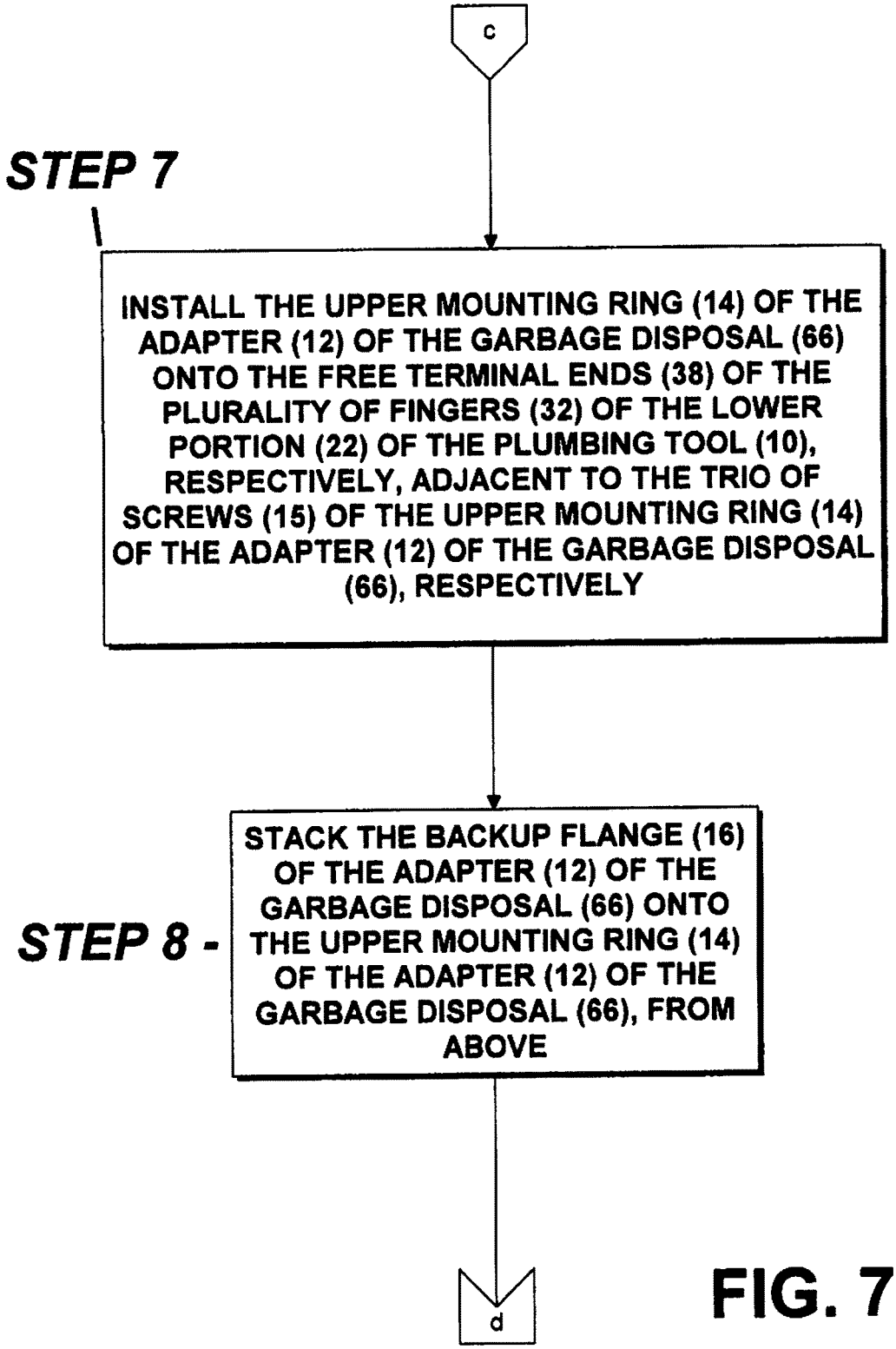
FIG. 7-D

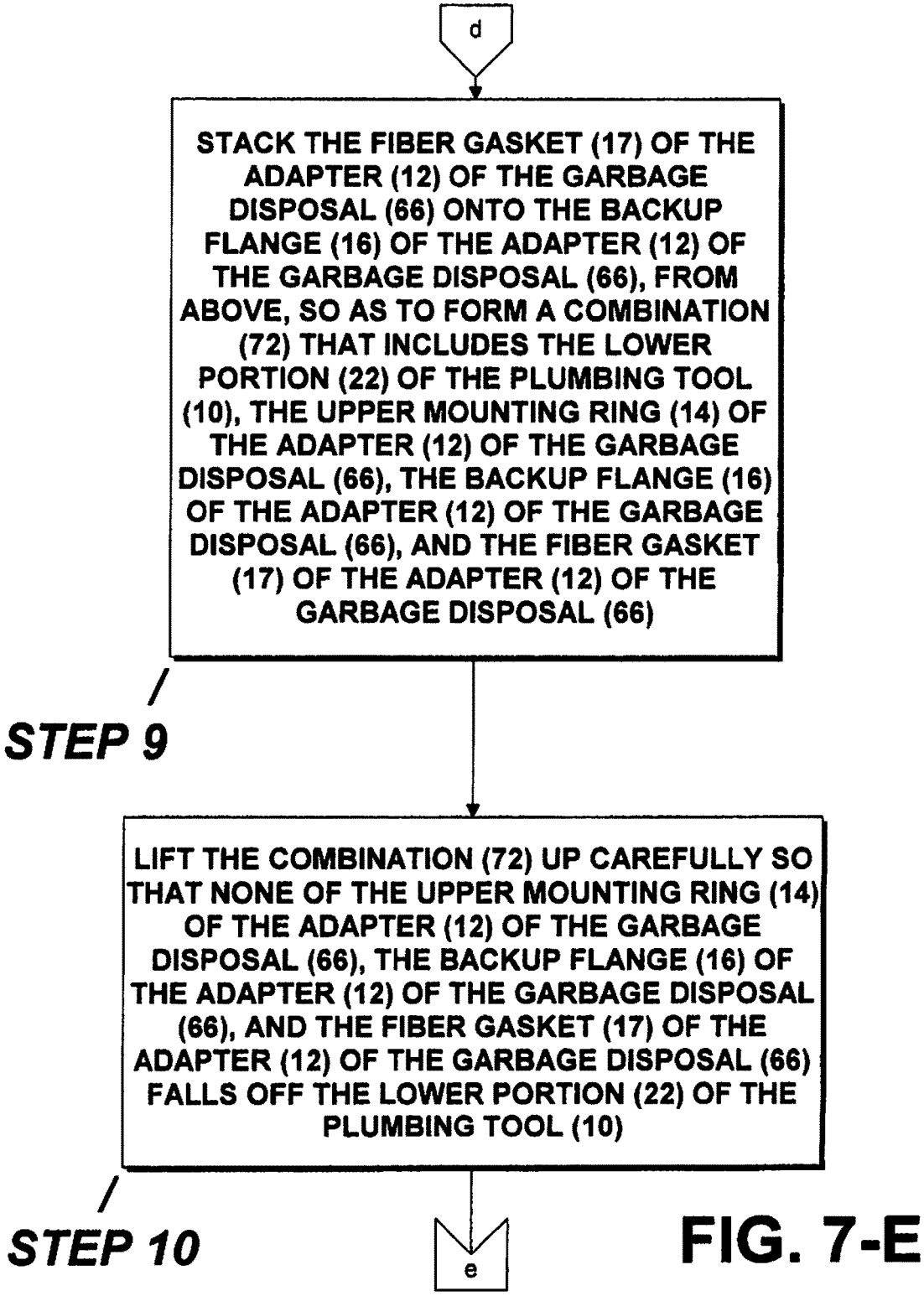
FIG. 7-E

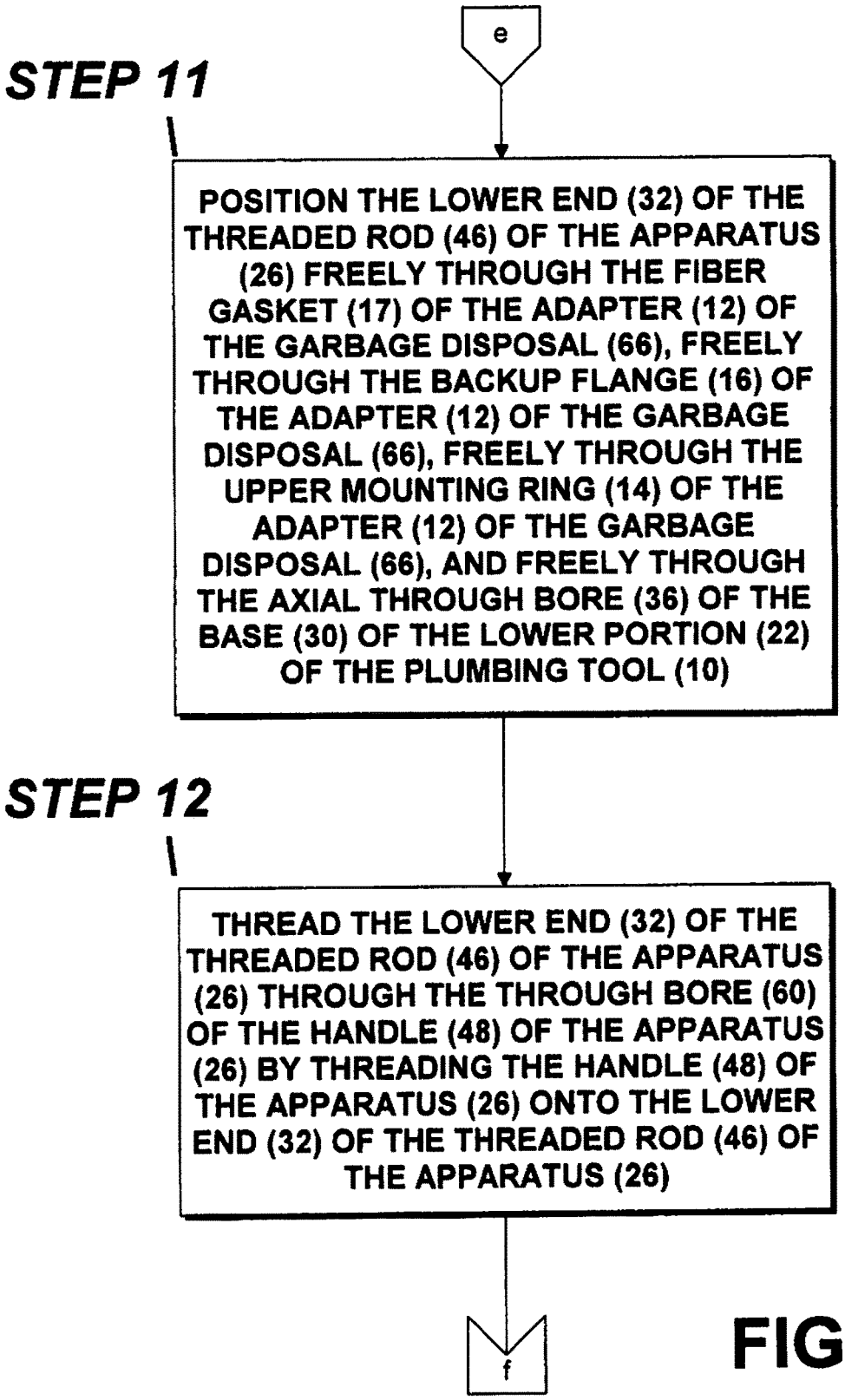
FIG. 7-F

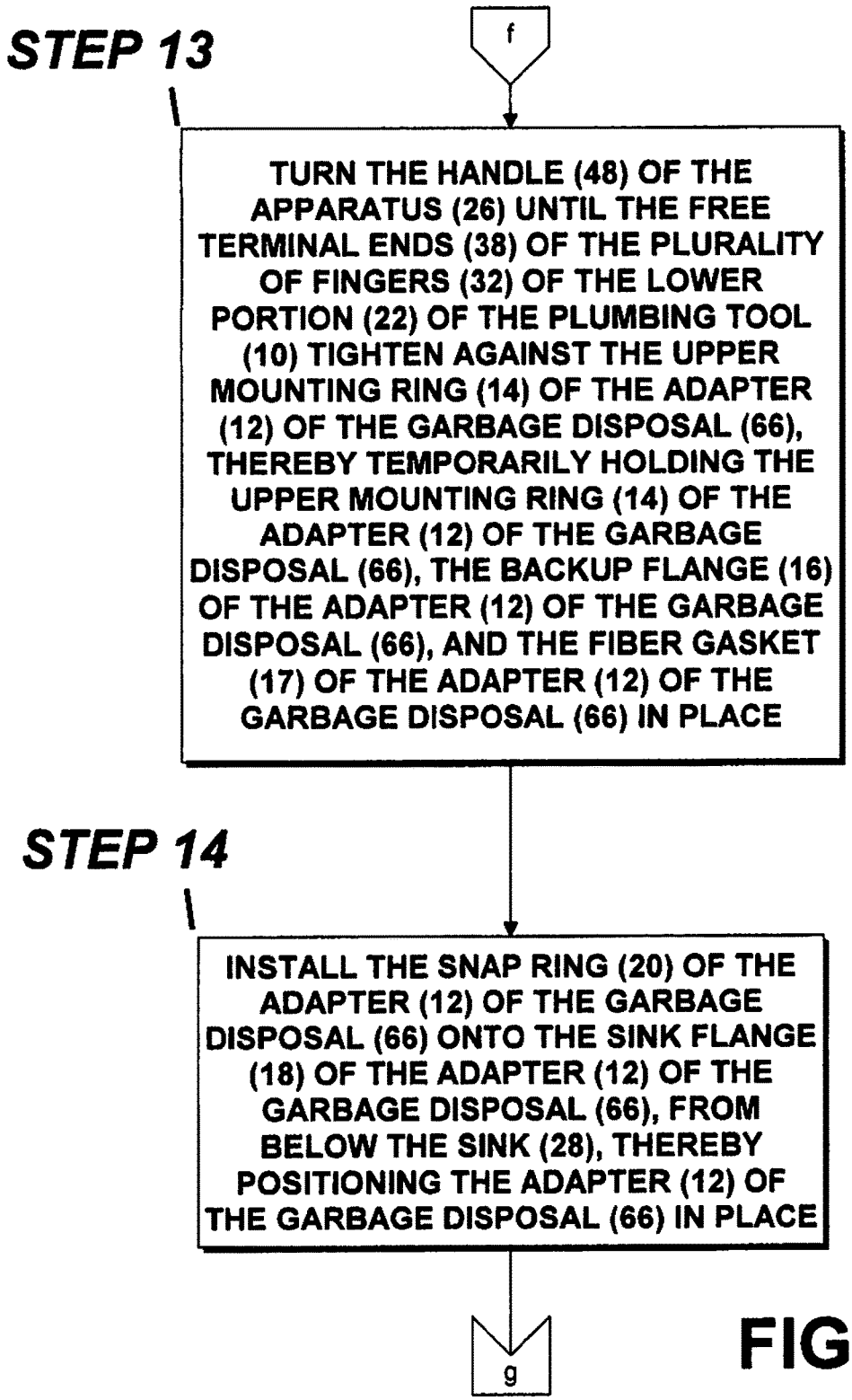
FIG. 7-G

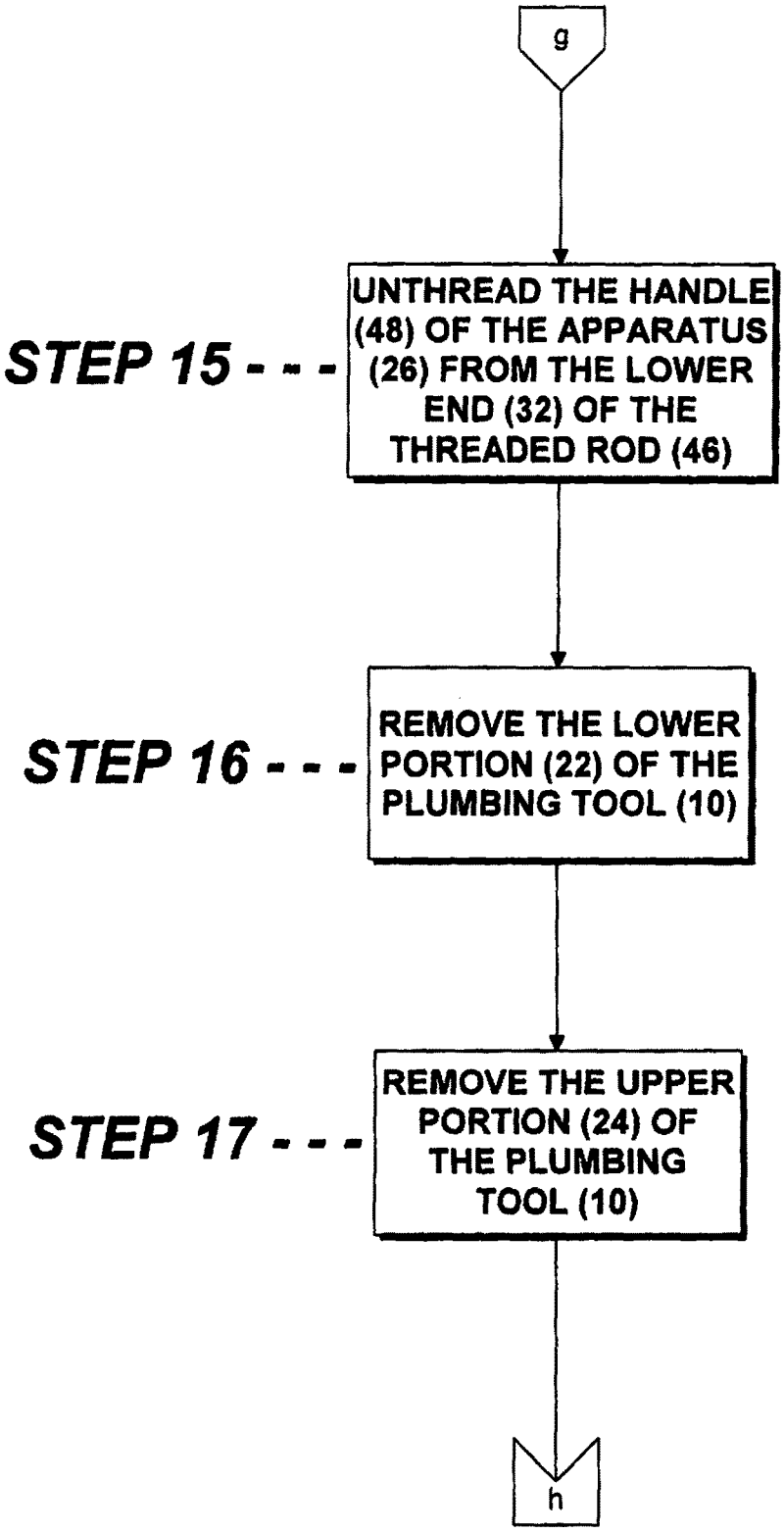
FIG. 7-H

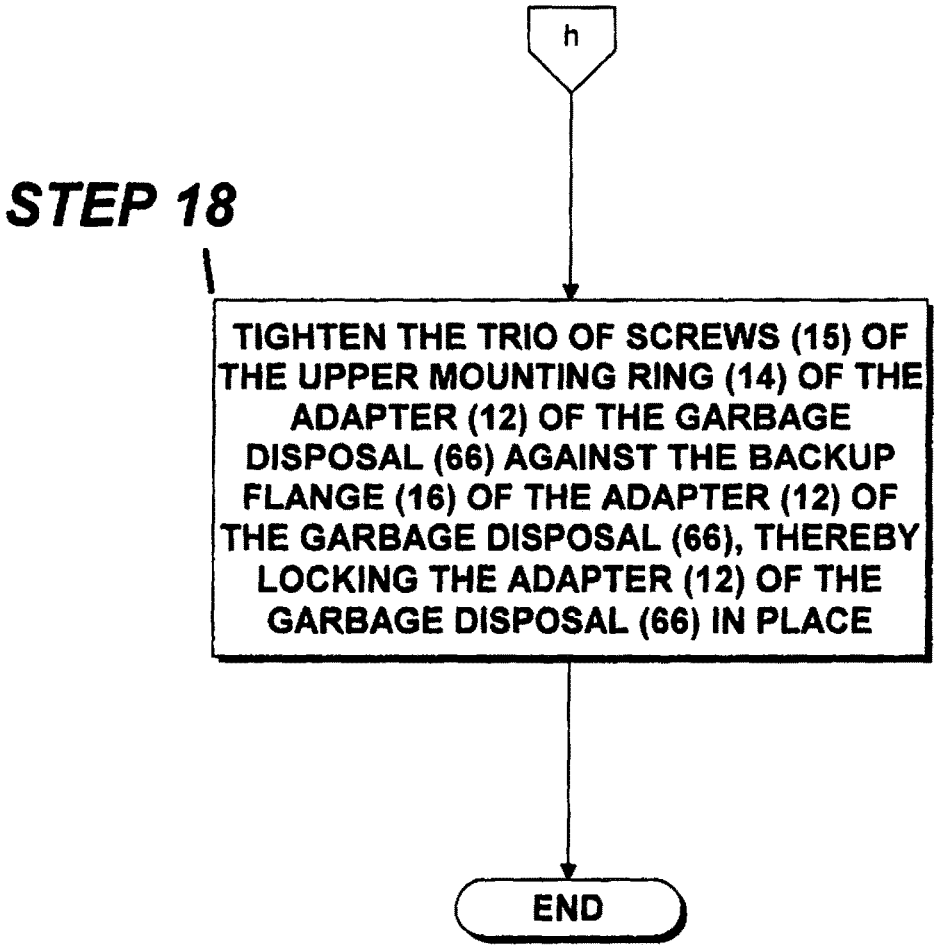
FIG. 7-I

DEVICE FOR AIDING IN DISPOSAL INSTALLATION

BACKGROUND OF THE INVENTION

Field of the Invention

The present invention relates to a plumbing tool, and more particularly, a plumbing tool for mounting an adapter of a garbage disposal to a sink.

Description of the Prior Art

When you flip switch to turn on the garbage disposal and all you get is a hum—or a loud and metal on metal grinding noise—you know something's wrong. Maybe it's just trash stuck in the disposal, but there is also a chance that the unit is dead, never to dispose again, and requires replacement.

Numerous innovations for plumbing tools have been provided in the prior art that will be described. Even though these innovations may be suitable for the specific individual purposes to which they address, however, they differ from the present invention.

A FIRST EXAMPLE, U.S. Pat. No. 5,177,853, Published/Issued on Jan. 12, 1993, to Herook teaches a tool for the installation of a sink flange and garbage disposal mounting flange assembly in the drain opening of a sink. The tool includes a generally U-shaped member having the tops of each side thereof extending outward, and a shaft member affixed to a central portion of the U-shaped member extending between the sides thereof. The shaft receives the mounting flange assembly and has a threaded portion passed through the drain opening in the sink in which is positioned the sink flange and on which shaft is positioned a retention member. The shaft passes through an aperture centrally defining the retention member with a handle member having a threaded engagement aperture to be screwed down on the shaft to retain the sink flange and garbage disposal mounting flange structure in place during installation thereof.

A SECOND EXAMPLE, U.S. Pat. No. 6,993,816, Published/Issued on Feb. 7, 2006, to Greenhill teaches a retaining ring installation tool for use in installing retaining rings onto shafts and into bores. The tool is formed from a single piece of metal to define a cylindrical and elongated body. A hollow cavity is formed in one end of the body, and the wall of the body that defines the cavity is slotted to form a plurality of individual and flexible spring contact arms or fingers that extend forwardly from a rear body portion and which collectively define an insertion end of the tool. The ends of the fingers are enlarged to ensure contact occurs between the tool and the retaining ring during the installation of the ring onto a shaft or into a bore. The contact arms are bent either radially inwardly or outwardly so that they will contact the retaining ring at all times during installation of the ring.

A THIRD EXAMPLE, U.S. Pat. No. 7,140,086, Published/Issued on Nov. 28, 2006, to Heaton teaches a support assembly for supporting a plumbing fixture in the course of effecting connections thereto. The assembly includes a base provided with a vertical tube segment supporting a nut assembly threadably engaged to a rod partly received in the segment, with the upper rod end supporting an adapter conformed to the supported fixture. An offset bar fixed to the rod exterior engages a lateral recess on the segment to fix the rod in rotation as the nut assembly is turned. The assembly may include rods of differing lengths and adapters of various forms.

A FOURTH EXAMPLE, U.S. Pat. No. 7,185,408, Published/Issued on Mar. 6, 2007, to Keith teaches a tool for installing a garbage disposal to a sink flange extending below a sink. The tool includes a keeper and a platform. The keeper includes a head portion for engaging the sink flange above the sink and a leg portion extending along the sink axis, through the sink flange. The platform carrying disposal mounting rings is releasably engaged with the leg portion below the sink to position it adjacent to, and aligned with, the end of the sink flange body. A snap ring is biased from the platform onto the flange body and into the annular groove in the flange body to trap the back-up ring and mounting ring on the flange body below the sink. The platform is disengaged from the leg portion, and the tool is removed, so that the disposal may be secured to the mounting ring in a known manner.

A FIFTH EXAMPLE, U.S. Pat. No. 7,921,532, Published/Issued on Apr. 12, 2011, to Heaton teaches a tool for installing a retainer ring onto the lower portion of a loosely inserted drain fitting for engaging a mounting flange thereto. The tool includes a generally resilient cup structure provided with a plurality of axially aligned and resiliently cantilevered peripherally adjacent strips within which the retaining ring is received in a compressed engagement seated on a helical interior shoulder. A threaded rod extends through a centering plug received in the drain fitting and then through the cup interior to axially advance the axially aligned ring carried by the strips.

A SIXTH EXAMPLE, U.S. Patent Office Document No. 20030192162, Published/Issued on Oct. 16, 2003, to Ramirez teaches a tool for installing a locking ring in an annular groove defined by a lower annular rim portion of a sink flange of a garbage disposer sink flange assembly. The tool includes a pair of elongated members that are pivotally connected at a pivot point to form a pair of opposed handles and a pair of opposed ring-engaging tips. The tips define a pair of outwardly facing indentations that adapt the tips to engaging the locking ring in order to spread the locking ring by operation of the person squeezing the handles toward each other. Mechanical stops are located in the opposing handles that prevent excessive spreading of the locking ring. In addition, the tool is configured so that when the tool is brought into position, and the tool is leaned over, the locking ring is released from the ring-engaging tips.

A SEVENTH EXAMPLE, U.S. Patent Office Document No. 20110154634, Published/Issued on Jun. 30, 2011, to Heaton teaches a tool for installing a retainer ring onto the lower portion of a loosely inserted drain fitting for engaging a mounting flange thereto. The tool includes a generally resilient cup structure provided with a plurality of axially aligned and resiliently cantilevered peripherally adjacent strips within which the retaining ring is received in a compressed engagement seated on a helical interior shoulder. A threaded rod extends through a centering plug received in the drain fitting and then through the cup interior to axially advance the axially aligned ring carried by the strips.

It is apparent now that numerous innovations for plumbing tools have been provided in the prior art that are adequate for various purposes. Furthermore, even though these innovations may be suitable for the specific individual purposes to which they address, accordingly, they would not be suitable for the purposes of the embodiments of the present invention as heretofore described.

SUMMARY OF THE INVENTION

AN OBJECT of the present invention is to provide a plumbing tool for mounting an adapter of a garbage disposal to a sink, which avoids the disadvantages of the prior art.

ANOTHER OBJECT of the present invention is to provide a plumbing tool for mounting an adapter of a garbage disposal to a sink, which is simple and inexpensive to manufacture.

STILL ANOTHER OBJECT of the present invention is to provide a plumbing tool for mounting an adapter of a garbage disposal to a sink, which is simple to use.

BRIEFLY STATED, STILL YET ANOTHER OBJECT of the present invention is to provide a plumbing tool that mounts an adapter of a garbage disposal to a sink, wherein the adapter of the garbage disposal includes an upper mounting ring with a trio of screws, a backup flange, a fiber gasket, a sink flange, and a snap ring. The plumbing tool includes a lower portion, an upper portion, and an apparatus. The apparatus selectively draws the lower portion to the upper portion to capture the adapter of the garbage disposal therebetween and thereby mount the adapter of the garbage disposal to the sink.

The novel features that are considered characteristic of the embodiments of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWINGS

The figures of the drawings are briefly described as follows:

FIGS. 7A-7I are a diagrammatic flowchart of the method for utilizing the embodiments of the present invention.

A MARSHALING OF REFERENCE NUMERALS UTILIZED IN THE DRAWINGS

Introductory

Figure 1:
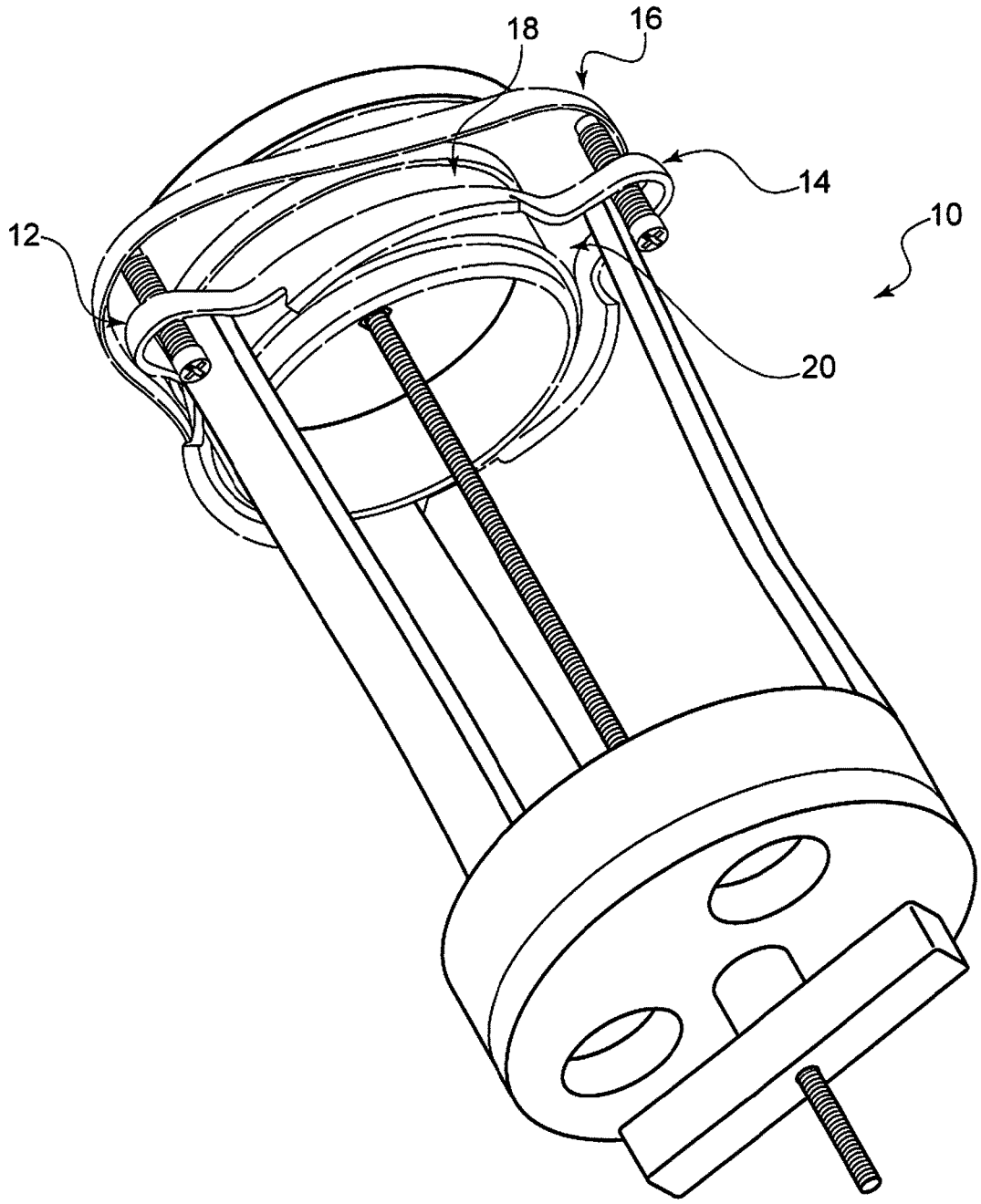
FIG. 1 is a diagrammatic perspective assembled view of the device for aiding in disposal installation with a set of sink drain parts captured therewith.
Figure 2:
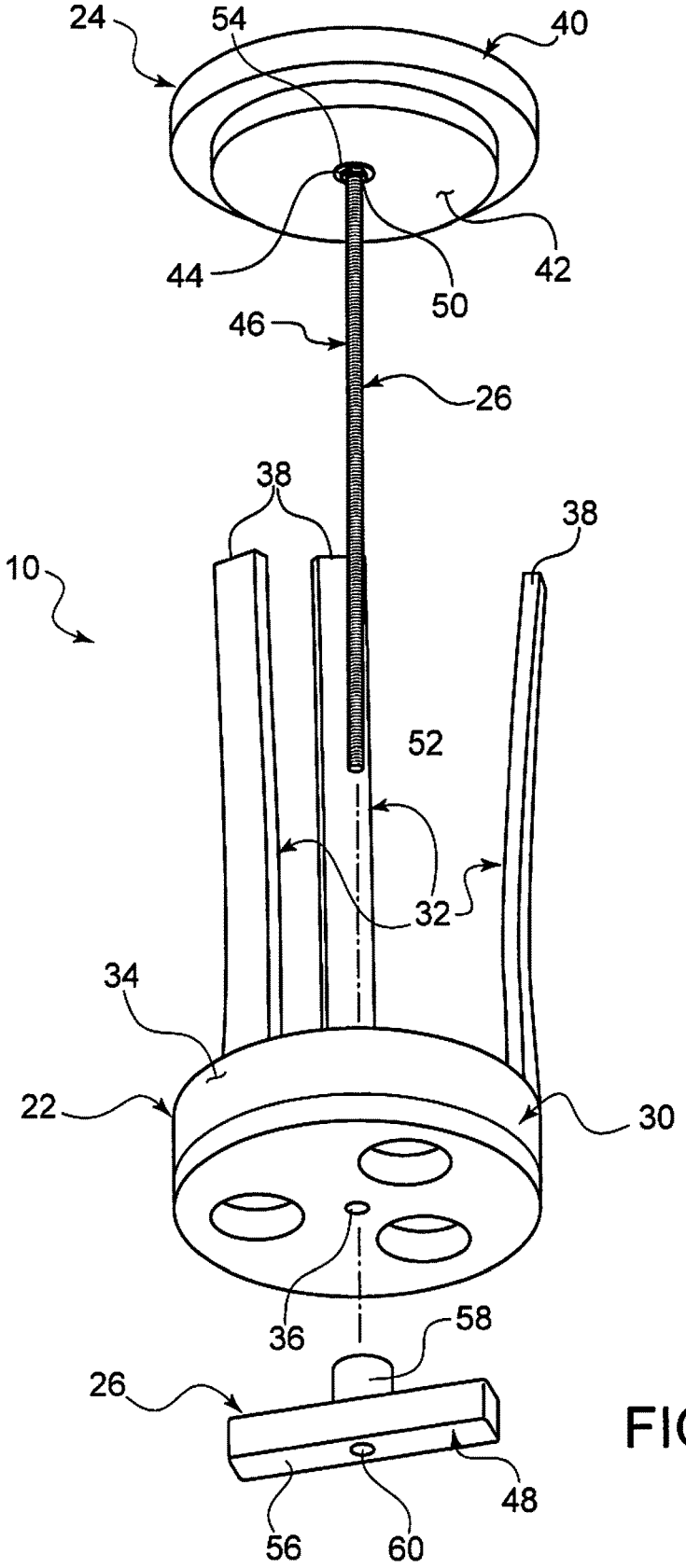
FIG. 2 is a diagrammatic perspective partially disassembled view of the device for aiding in disposal installation per se.
Figure 3:
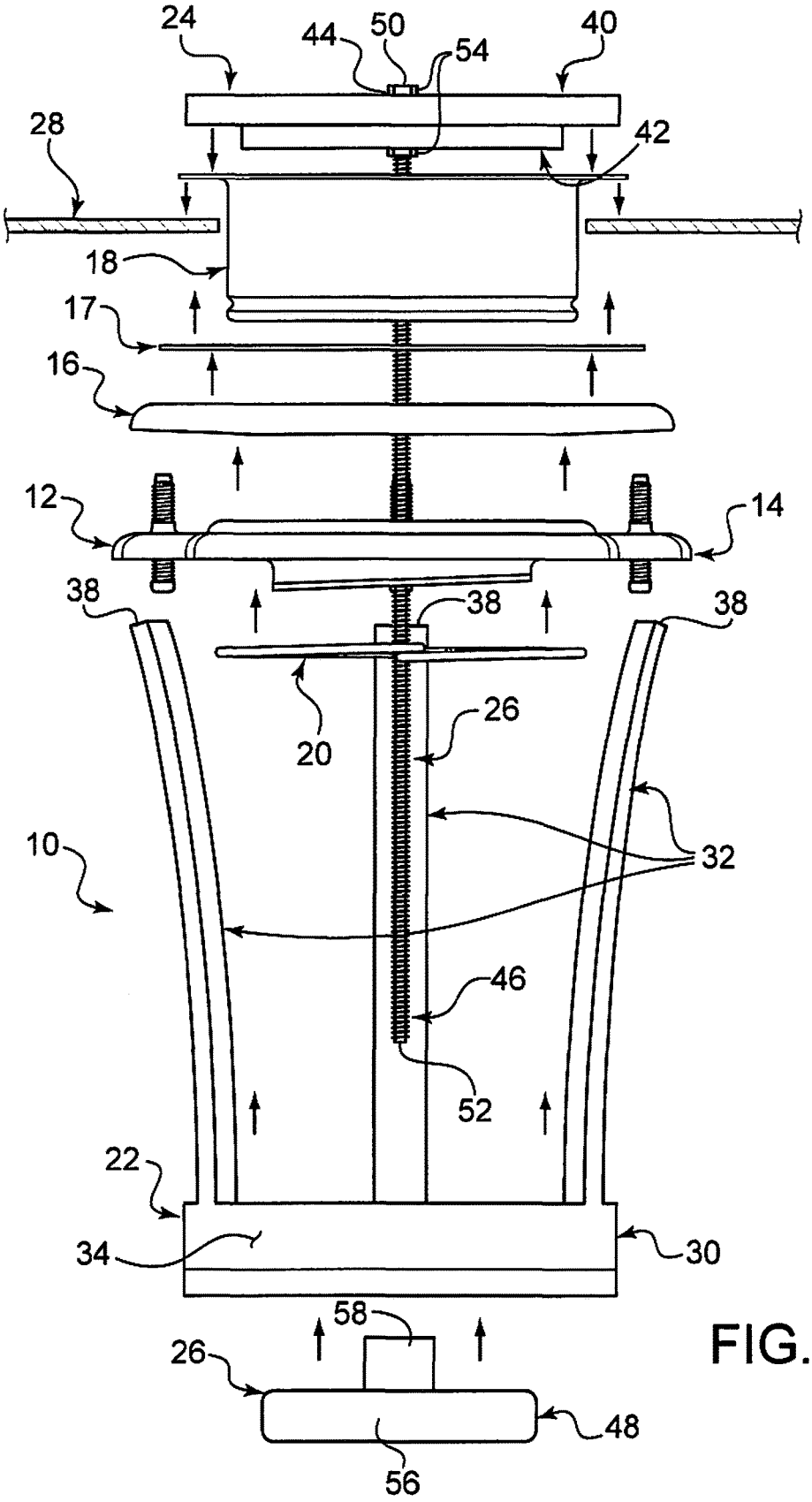
FIG. 3 is an exploded side elevational view of the device for aiding in disposal installation showing the relationship among all the parts of the device and how it cooperates with the sink drain parts and a sink basin.
Figure 4:
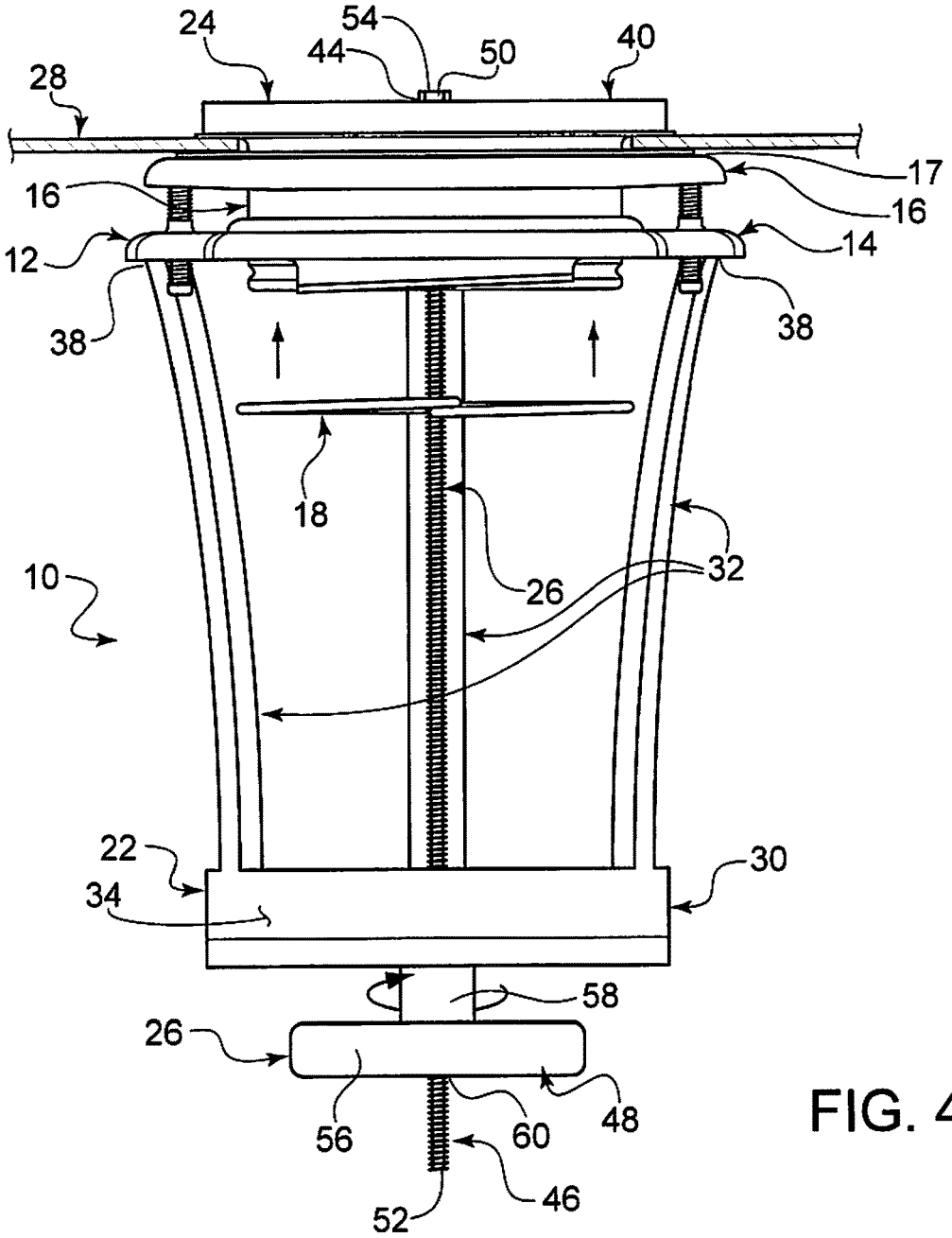
FIG. 4 is a side elevational view showing all the sink drain parts clamped together utilizing the device after they have been located and assembled in a sink drain, shown in section, so that a fastening snap ring can be snapped in place.

10 plumbing tool of embodiments of present invention for mounting adapter 12 of garbage disposal to sink
12 mounting adapter of garbage disposal
14 upper mounting ring of mounting adapter 12 of garbage disposal
15 trio of screws of upper mounting ring 14 of mounting adapter 12 of garbage disposal
16 backup flange of mounting adapter 12 of garbage disposal
17 fiber gasket of mounting adapter 12 of garbage disposal
18 sink flange of mounting adapter 12 of garbage disposal
19 flange of sink flange 18 of mounting adapter 12 of garbage disposal
20 snap ring of mounting adapter 12 of garbage disposal

Overall Configuration of Plumbing Tool 10

22 lower portion
24 upper portion
26 apparatus
28 sink

Specific Configuration of Lower Portion 22, Upper Portion 24, and Apparatus 26

Lower Portion 22

30 base of lower portion 22
32 plurality of fingers of lower portion 22
34 periphery of base 30 of lower portion 22
36 axial through bore of base 30 of lower portion 22
38 free terminal ends of plurality of fingers 32 of lower portion 22, respectively

Upper Portion 24

40 outer disk of upper portion 24
42 inner disk of upper portion 24
44 axial through bore of upper portion 24

Apparatus 26

46 threaded rod of apparatus 26
48 handle of apparatus 26
50 upper end of threaded rod 46 of apparatus 26
52 lower end of threaded rod 46 of apparatus 26
54 pair of nuts of apparatus 26
56 horizontal portion of handle 48 of apparatus 26
58 vertical portion of handle 48 of apparatus 26
60 through bore of handle 48 of apparatus 26

Method for Utilizing Plumbing Tool 10 to Install Adapter 12 that Mounts Garbage Disposal to Sink 28

62 plumber's putty
64 snake
66 garbage disposal
68 drain of sink 28
70 support surface
72 combination

DETAILED DESCRIPTION OF THE PREFERRED EMBODIMENT

Introductory

Figure 5:
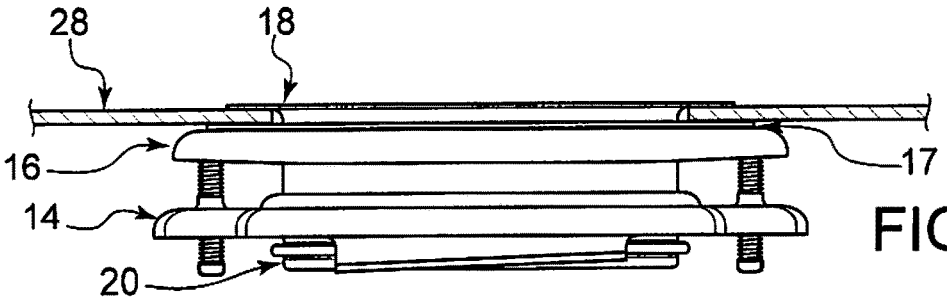
FIG. 5 is a side elevational view showing all the drain parts installed in a sink basin after having been held in place utilizing the device of the present invention.
Figure 6:
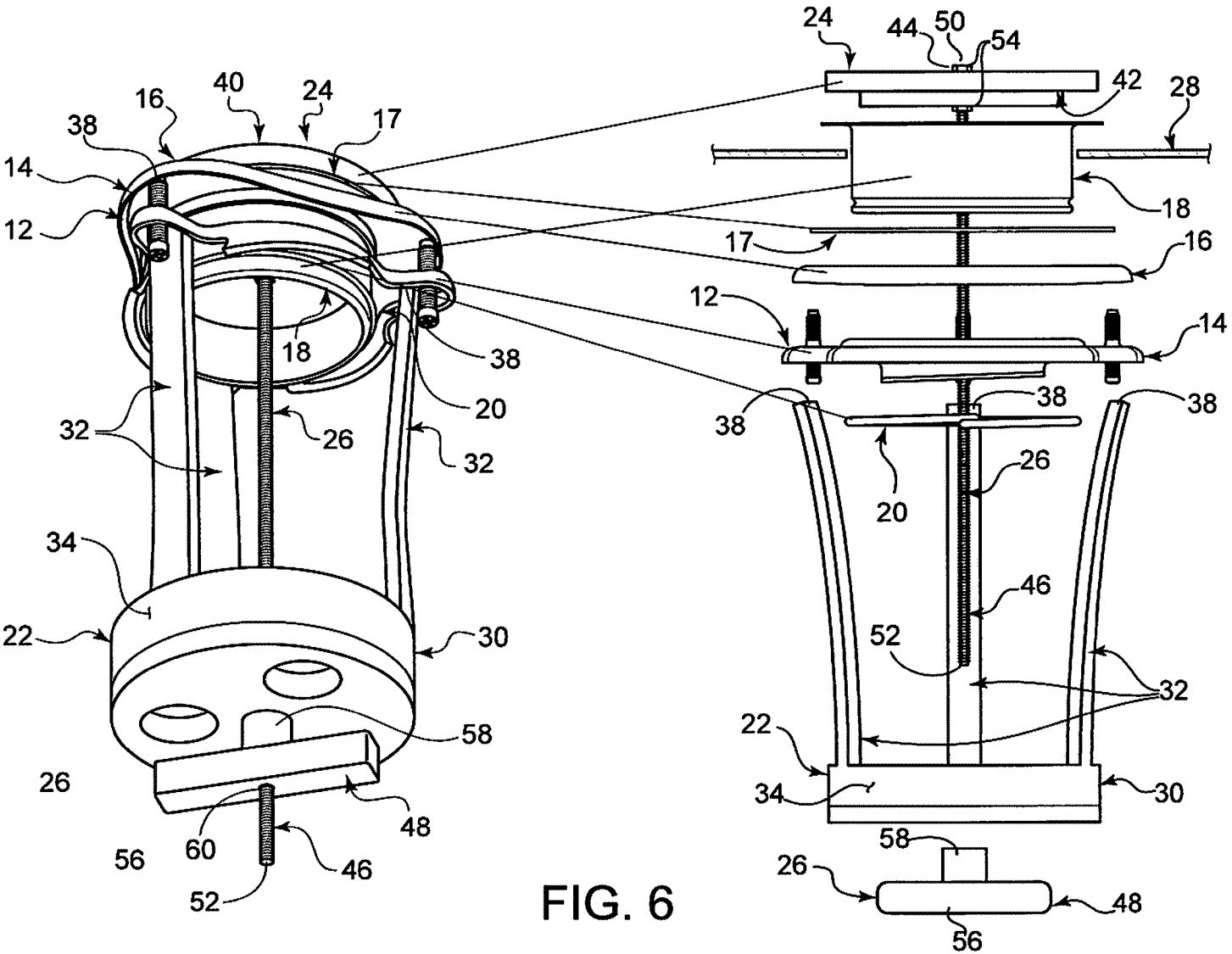
FIG. 6 is a diagrammatic view corresponding the parts shown in perspective views with the parts shown in side elevational views.

Referring now to the figures, in which like numerals indicate like parts, and particularly to FIGS. 1 and 5, the plumbing tool of the embodiments of the present invention is shown generally at 10 for mounting an adapter 12 of a garbage disposal to a sink, wherein the adapter 12 of the garbage disposal comprises an upper mounting ring 14 with a trio of screws 15, a backup flange 16, a fiber gasket 17, a sink flange 18 with a flange 19, and a snap ring 20.

The Overall Configuration of the Plumbing Tool 10

The overall Configuration of the plumbing tool 10 can best be seen in FIGS. 2-4 and 6, and as such, will be discussed with reference thereto.

The plumbing tool 10 comprises a lower portion 22, an upper portion 24, and an apparatus 26.

The apparatus 26 selectively draws the lower portion 22 to the upper portion 24 for capturing the adapter 12 of the garbage disposal therebetween for mounting the adapter 12 of the garbage disposal to the sink 28.

Specific Configuration of the Lower Portion 22, the Upper Portion 24, and the Apparatus 26

The Lower Portion 22

The lower portion 22 comprises a base 30 and a plurality of fingers 32.

The base 30 of the lower portion 22 is disk-shaped and has a periphery 34.

The base 30 of the lower portion 22 further has an axial through bore 36.

The plurality of fingers 32 of the lower portion 22 are slender, elongated, of equal length, three in number, slightly outwardly bent, extend upwardly from the periphery 34 of the base 30 of the lower portion 22 to free terminal ends 38, respectively, and are 120° spaced-apart from each other.

The Upper Portion 24

The upper portion 24 comprises an outer disk 40 and an inner disk 42.

The inner disk 42 of the upper portion 24 is smaller than, is concentrically attached to, and is below, the outer disk 40 of the upper portion 24.

The upper portion 24 has an axial through bore 44.

The Apparatus 26

The apparatus 26 comprises a threaded rod 46 and a handle 48.

The threaded rod 46 of the apparatus 26 has an upper end 50 and a lower end 52.

The upper end 50 of the threaded rod 46 of the apparatus 26 extends into the axial through bore 44 of the upper portion 24 from below, and is maintained thereat by, a pair of nuts 54.

The pair of nuts 54 of the apparatus 26 sandwich the upper portion 24 therebetween.

The handle 48 of the apparatus 26 is T-shaped, and as such, has a horizontal portion 56 and a vertical portion 58.

The handle 48 of the apparatus 26 further has a through bore 60.

The through bore 60 of the handle 48 of the apparatus 26 extends centrally through the horizontal portion 56 of the handle 48 of the apparatus 26 and axially through the vertical portion 58 of the handle 48 of the apparatus 26, and is threaded.

The lower end 52 of the threaded rod 46 of the apparatus 26 passes freely through the axial through bore 36 of the base 30 of the lower portion 22, and threadably through the through bore 60 of the handle 48 of the apparatus 26.

Method for Utilizing the Plumbing Tool 10 to Install the Adapter 12 that Mounts the Garbage Disposal to the Sink 28

The method for utilizing the plumbing tool 10 to install the adapter 12 that mounts the garbage disposal 66 to the sink 28 can best be seen in FIGS. 7A-7ZZ, and as such, will be discussed with reference thereto.

The method for utilizing the plumbing tool 10 to install the adapter 12 that mounts the garbage disposal 66 to the sink 28, comprises the steps of:

STEP 1: Roll a ball of plumber's putty 62 into a snake 64;

STEP 2: Install the snake 64 of the plumber's putty 62 under and around the flange 19 of the sink flange 18 of the adapter 12 of the garbage disposal 66;

STEP 3: Press the sink flange 18 of the adapter 12 of the garbage disposal 66 into the drain 68 of the sink 28, from above the sink 28;

STEP 4: Attach the upper end 50 of the threaded rod 46 of the apparatus 26 to the upper portion 24 of the plumbing tool 10, using the pair of nuts 54 of the apparatus 26;

STEP 5: Position the upper portion 24 of the plumbing tool 10 into the sink flange 18 of the adapter 12 of the garbage disposal 66, from above the sink 28, leaving the lower end 52 of the threaded rod 46 of the apparatus 26 extending below the sink 28;

STEP 6: Rest the lower portion 22 of the plumbing tool 10 on a support surface 70, under the sink 28;

STEP 7: Install the upper mounting ring 14 of the adapter 12 of the garbage disposal 66 onto the free terminal ends 38 of the plurality of fingers 32 of the lower portion 22 of the plumbing tool 10, respectively, adjacent to the trio of screws 15 of the upper mounting ring 14 of the adapter 12 of the garbage disposal 66, respectively;

STEP 8: Stack the backup flange 16 of the adapter 12 of the garbage disposal 66 onto the upper mounting ring 14 of the adapter 12 of the garbage disposal 66, from above;

STEP 9: Stack the fiber gasket 17 of the adapter 12 of the garbage disposal 66 onto the backup flange 16 of the adapter 12 of the garbage disposal 66, from above, so as to form a combination 72 that includes the lower portion 22 of the plumbing tool 10, the upper mounting ring 14 of the adapter 12 of the garbage disposal 66, the backup flange 16 of the adapter 12 of the garbage disposal 66, and the fiber gasket 17 of the adapter 12 of the garbage disposal 66;

STEP 10: Lift the combination 72 up carefully so that none of the upper mounting ring 14 of the adapter 12 of the garbage disposal 66, the backup flange 16 of the adapter 12 of the garbage disposal 66, and the fiber gasket 17 of the adapter 12 of the garbage disposal 66 falls off the lower portion 22 of the plumbing tool 10;

STEP 11: Position the lower end 32 of the threaded rod 46 of the apparatus 26 freely through the fiber gasket 17 of the adapter 12 of the garbage disposal 66, freely through the backup flange 16 of the adapter 12 of the garbage disposal 66, freely through the upper mounting ring 14 of the adapter 12 of the garbage disposal 66, and freely through the axial through bore 36 of the base 30 of the lower portion 22 of the plumbing tool 10;

STEP 12: Thread the lower end 32 of the threaded rod 46 of the apparatus 26 through the through bore 60 of the handle 48 of the apparatus 26 by threading the handle 48 of the apparatus 26 onto the lower end 32 of the threaded rod 46 of the apparatus 26;

STEP 13: Turn the handle 48 of the apparatus 26 until the free terminal ends 38 of the plurality of fingers 32 of the lower portion 22 of the plumbing tool 10 tighten against the upper mounting ring 14 of the adapter 12 of the garbage disposal 66, thereby temporarily holding the upper mounting ring 14 of the adapter 12 of the garbage disposal 66, the backup flange 16 of the adapter 12 of the garbage disposal 66, and the fiber gasket 17 of the adapter 12 of the garbage disposal 66 in place;

STEP 14: Install the snap ring 20 of the adapter 12 of the garbage disposal 66 onto the sink flange 18 of the adapter 12 of the garbage disposal 66, from below the sink 28, thereby positioning the adapter 12 of the garbage disposal 66 in place;

STEP 15: Unthread the handle 48 of the apparatus 26 from the lower end 32 of the threaded rod 46;

STEP 16: Remove the lower portion 22 of the plumbing tool 10;

STEP 17: Remove the upper portion 24 of the plumbing tool 10; and

STEP 18: Tighten the trio of screws 15 of the upper mounting ring 14 of the adapter 12 of the garbage disposal 66 against the backup flange 16 of the adapter 12 of the garbage disposal 66, thereby locking the adapter 12 of the garbage disposal 66 in place.

Impressions

It will be understood that each of the elements described above, or two or more together, may also find a useful application in other types of constructions differing from the types described above.

While the invention has been illustrated and described as embodiments of a device for aiding in disposal installation, accordingly it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A plumbing tool for mounting an adapter of a garbage disposal to a sink, wherein the adapter of the garbage disposal includes:

i) an upper mounting ring with a trio of screws, ii) a backup flange, iii) a fiber gasket, iv) a sink flange, and v) a snap ring, wherein said plumbing tool, comprising:

a) a lower portion;

b) an upper portion; and c) an apparatus;

wherein said apparatus selectively draws said lower portion to said upper portion for capturing the adapter of the garbage disposal therebetween for mounting the adapter of the garbage disposal to the sink;

wherein said lower portion comprises a base;

wherein said lower portion comprises a plurality of fingers;

wherein said base of said lower portion is disk-shaped wherein said base of said lower portion has a periphery; and wherein said plurality of fingers of said lower portion are slightly outwardly bent in a curved shape.

2. The plumbing tool of claim 1, wherein said base of said lower portion has an axial through bore.

3. The plumbing tool of claim 2, wherein said plurality of fingers of said lower portion are slender.

4. The plumbing tool of claim 3, wherein said plurality of fingers of said lower portion are elongated.

5. The plumbing tool of claim 4, wherein said plurality of fingers of said lower portion are of equal length.

6. The plumbing tool of claim 5, wherein said plurality of fingers of said lower portion are three in number.

7. The plumbing tool of claim 6, wherein said plurality of fingers of said lower portion extend upwardly from said periphery of said base of said lower portion to free terminal ends, respectively.

8. The plumbing tool of claim 7, wherein said plurality of fingers of said lower portion are 120° spaced-apart from each other.

9. The plumbing tool of claim 1, wherein said upper portion comprises an outer disk.

10. The plumbing tool of claim 9, wherein said upper portion comprises inner disk.

11. The plumbing tool of claim 10, wherein said inner disk of said upper portion is smaller than said outer disk of said upper portion.

12. The plumbing tool of claim 10, wherein said inner disk of said upper portion is concentrically attached to said outer disk of said upper portion.

13. The plumbing tool of claim 10, wherein said inner disk of said upper portion is below said outer disk of said upper portion.

14. The plumbing tool of claim 1, wherein said upper portion has an axial through bore.

15. The plumbing tool of claim 14, wherein said apparatus comprises a threaded rod.

16. The plumbing tool of claim 15, wherein said threaded rod of said apparatus has an upper end.

17. The plumbing tool of claim 16, wherein said upper end of said threaded rod of said apparatus extends into said axial through bore of said upper portion from below.

18. The plumbing tool of claim 16, wherein said upper end of said threaded rod of said apparatus is maintained in said axial through bore of said upper portion by a pair of nuts.

19. The plumbing tool of claim 18, wherein said pair of nuts of said apparatus sandwich said upper portion therebetween.

20. The plumbing tool of claim 15, wherein said apparatus comprises a handle.

21. The plumbing tool of claim 20, wherein said handle of said apparatus is T-shaped.

22. The plumbing tool of claim 20, wherein said threaded rod of said apparatus has a lower end.

23. The plumbing tool of claim 22, wherein said handle of said apparatus has a horizontal portion.

24. The plumbing tool of claim 23, wherein said handle of said apparatus has a vertical portion.

25. The plumbing tool of claim 24, wherein said handle of said apparatus has a through bore.

26. The plumbing tool of claim 25, wherein said through bore of said handle of said apparatus extends centrally through said horizontal portion of said handle of said apparatus and axially through said vertical portion of said handle of said apparatus.

27. The plumbing tool of claim 25, wherein said through bore of said handle of said apparatus is threaded.

28. The plumbing tool of claim 25, wherein said lower end of said threaded rod of said apparatus passes freely through said axial through bore of said base of said lower portion, and threadably through said through bore of said handle of said apparatus.

* * * * *